US005662291A

United States Patent [19]

Sepp et al.

[11] Patent Number: 5,662,291

[45] Date of Patent: Sep. 2, 1997

[54] DEVICE FOR SELF-DEFENSE AGAINST MISSILES

[75] Inventors: Gunther Sepp, Ottobrunn; Rudolf Protz, Höhenkirchen-Siegertsbrunn, both of Germany

[73] Assignee: Daimler-Benz Aerospace AG, Germany

[21] Appl. No.: 574,442

[22] Filed: Dec. 15, 1995

[30] Foreign Application Priority Data

Dec. 15, 1994 [DE] Germany ..... 44 44 635.7

[51] Int. Cl.[6] ..... F41G 7/26; F41G 7/22

[52] U.S. Cl. ..... 244/3.13; 244/3.11; 244/3.16; 89/1.11

[58] Field of Search ..... 244/3.11, 3.13, 244/3.15, 3.16; 89/1.1, 1.11; 342/13, 19, 62; 364/922.5, 223.1; 434/14

[56] References Cited

U.S. PATENT DOCUMENTS

| | | | |
|---|---|---|---|
| 4,324,491 | 4/1982 | Hueber | 356/152 |
| 4,383,663 | 5/1983 | Nichols | 244/3.16 |
| 4,471,683 | 9/1984 | Brown | 89/1.1 |
| 4,676,455 | 6/1987 | Diehl et al. | 244/3.13 |
| 4,796,834 | 1/1989 | Ahlstrom | 244/3.16 |
| 4,959,015 | 9/1990 | Rasinski et al. | 434/2 |
| 5,472,156 | 12/1995 | Biven, III et al. | 244/234 |
| 5,549,477 | 8/1996 | Tran et al. | 434/5 |
| 5,600,434 | 2/1997 | Warm et al. | 356/139.08 |

OTHER PUBLICATIONS

"Army EH–60 to Flight Test Sanders Directed IR Jammer," Aviation Week and Space Technology Mar. 28, 1994.

*Primary Examiner*—Michael J. Carone
*Assistant Examiner*—Christopher K. Montgomery
*Attorney, Agent, or Firm*—Evenson, McKeown, Edwards & Lenahan P.L.L.C.

[57] ABSTRACT

The invention relates to a device for self-defense of aircraft against missiles and provides for a combination of a proximity sensor for the enemy missile, an intercepting rocket, and an aimed light beam, with the light beam optionally being used alone as an optical jammer against an optical homing head on the missile, or being used together with the intercepting rocket to steer it optically by either a semi-active or a beam rider steering method.

13 Claims, 2 Drawing Sheets

DEVICE FOR SELF-DEFENSE AGAINST MISSILES

BACKGROUND AND SUMMARY OF THE INVENTION

The invention relates to a missile system in which either a jamming laser beam or intercepting rockets are triggered in response to detection of incoming missiles.

A defense system of this kind is disclosed in the publication "Aviation Week and Space Technology," Mar. 28, 1994, Pages 57–60. It consists of an electronic control unit, an "IR Jammer Head", and an electro-optical missile sensor. The gimbal-mounted "IR Jammer Head" is provided with three openings, of which the largest is intended for a xenon arc lamp, the middle opening contains the optical elements for the array sensor in the missile tracker, and the smallest opening is for the laser optics. This device, however, is ineffective against missiles which do not have optical homing heads, and has only limited utility against those with modern infrared homing heads.

While missiles with optical homing heads can be combated both with jammer lasers and with intercepting rockets, the use of intercepting rockets is very uneconomical in this respect. Missiles without optical homing heads, on the other hand, can only be combated practically with intercepting rockets.

The object of the present invention is to provide a missile defense system which assures reliable, safe, and more economical self-defense against missiles of all the types mentioned.

This object is achieved according to the invention by the combination of a proximity sensor for the enemy missile, an intercepting rocket and an aimed light beam. The light beam can be used either alone, as an optical jammer against an optical homing head of the incoming missile, or together with the intercepting rocket, to steer it optically using either a semi-active or beam rider steering method. The missile defense system according to the invention may be either ground based or carried aboard an aircraft.

Other objects, advantages and novel features of the present invention will become apparent from the following detailed description of the invention when considered in conjunction with the accompanying drawings.

DETAILED DESCRIPTION OF THE DRAWING

Figure 1:
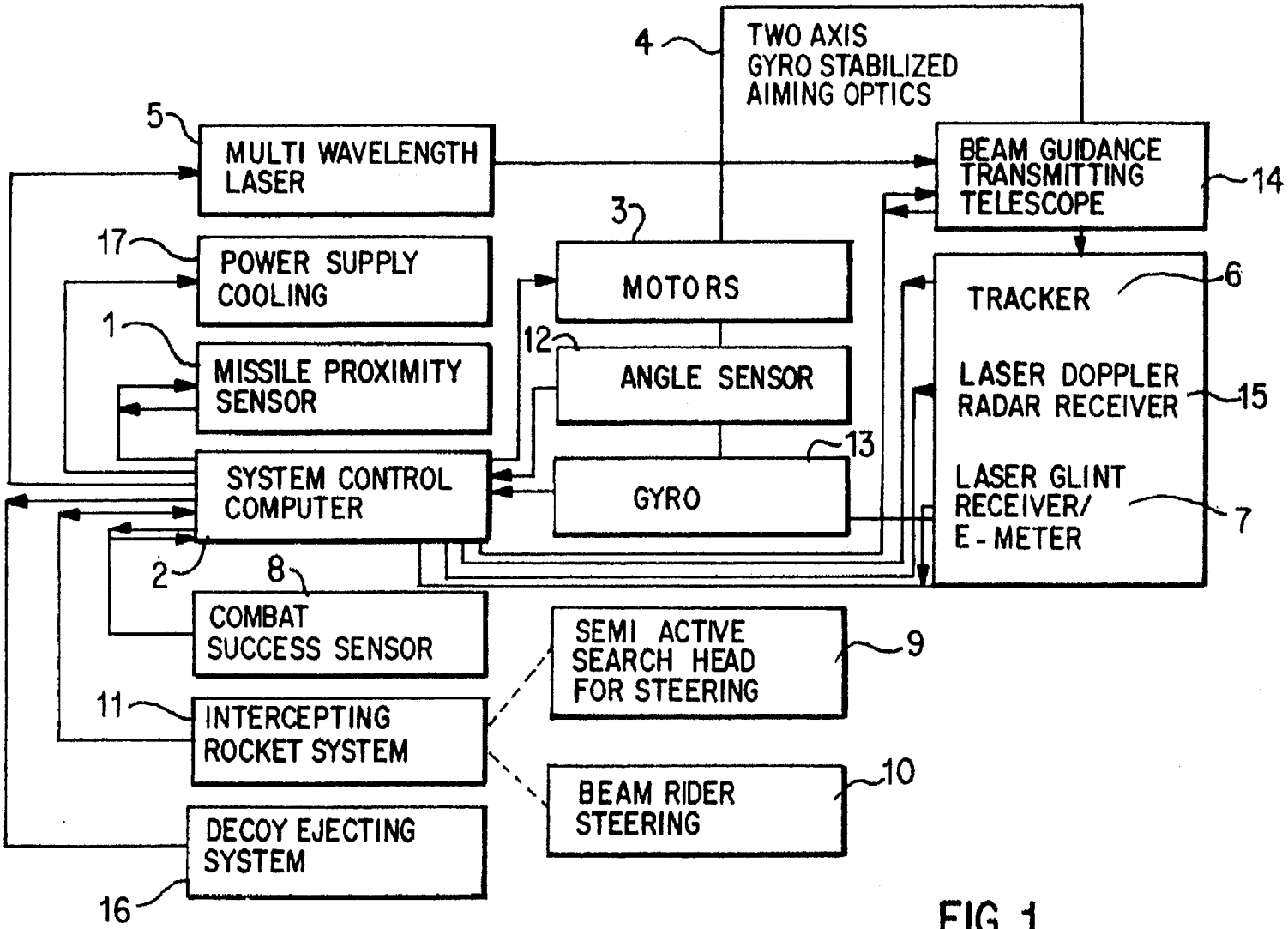
FIG. 1 shows a conceptual block diagram of the components of the missile defense system according to the invention.

In the Figure, which shows a conceptual block diagram of the missile defense system according to the invention, a missile proximity sensor 1 detects the presence of an incoming missile and provides this information to a control computer 2 which initially decides whether the enemy missile detected by the proximity sensor should be combated by optical jamming or by an intercepting rocket. This determination is made based on advance information derived from intelligence data or electronic reconnaissance data, concerning the probability that the enemy missile is provided with an optical homing head; if so, the first priority is given to optical jamming. If the decision is made to use optical jamming, the control computer 2 calculates the direction toward the nose of the missile, where its optical homing head is located, drives servo motors 3 to aim an aiming optics 4 (stabilized in two axes by gyro 13 and angle sensor 12, for example) with a beam guidance transmitting telescope 14, and irradiates the homing head of the enemy missile with a multiwavelength laser beam from a multiwavelength laser 5 having a power supply/cooling unit 17. This multiwavelength laser beam has been optimized for optical jamming. If the jamming is successful, the missile then loses its target, and as a rule a hit is avoided.

In order to ensure effective optical jamming of the homing head, the laser beam comprises wavelengths within at least one of the wavelength ranges that are used for optical homing heads. Preferably, a laser device with diode-pumped solid state lasers and an optical-parametric oscillator connected thereto is used as the light source. Preferably, the laser device 5 emits a beam with a plurality of wavelengths in the ranges 0.7–1.2 μm, 2–3 μm, and 3–5 μm.

The optical jamming system according to the invention is provided with a tracker 6 that measures and analyzes the light back scattered from the marked missile with a glint receiver 7, or simultaneously or alternately with Laser-Doppler radar receiver 15, and feeds the resultant measurement signals to the system control computer 2 which in turn controls the aiming optics 4 of the laser beams as noted previously, so that it is aimed at the nose (i.e., the position of the missile), and is held there, where an optical homing head is assumed to exist.

A so-called combat success sensor 8 associated with the system control computer analyzes signals from the missile proximity sensor, the tracker 6, and an inertial sensor (not shown) of the aircraft in which the system is mounted, determines whether the incoming path of the attacking missile has been sufficiently jammed, in a manner described hereinafter. If this is the case within a sufficient safety margin, the defense process can be suspended. However, if this is not the case, the control computer 2 then proceeds to combat the enemy missile with an intercepting rocket, which is guided optically by a directed light beam, using conventional guidance techniques, such as a semi-active steering method 9 or a beam rider steering method 10, as explained hereinafter. The control computer accordingly calculates the direction either to a point of maximum vulnerability of the missile (that is, the point on the missile airframe near the guidance section, where a hit can have greatest impact on trajectory) in the case of semi-active steering, or to a calculated point of collision between the intercepting rocket and the missile (beam rider steering). It also determines whether the wavelength and modulation of the light beam should be optimized and set (with respect to wavelength, modulation of beam intensity and beam divergence) for the semi-active steering method or for the beam rider steering method, and fires an appropriately aimed intercepting rocket 11. (For optimization of the light beam, preferably either the laser light generated by the solid state laser or by the laser diodes is used.)

The selection as between semi-active steering and beam rider steering may be determined in the first instance by the type of intercepting rocket that is used with the system. If both types are available, the selection is determined by factors such as distance and trajectory of the incoming missile.

Preferably a semi-active steering method 9 is used, in which a highly collimated light beam is aimed and held by the tracker on the most favorable spot on the attacking missile. The light beam is used to guide the intercepting rocket 11, which is provided with a suitable homing head. Preferably, the homing head is aimed at the attacking missile even before the rocket is fired, and once it has discovered the light beam back scattered from the missile, the rocket is fired. Thereafter, the intercepting rocket is guided by the reflected light in a known manner.

A so-called beam rider steering method 10 may also be used. In this method, the tracker modulates the spatial intensity distribution of the expanded light beam to achieve a diameter adapted to that of the flight channel of the interceptor rocket, which derives local position information relative to the beam axis, from the waveform of the modulated light in a known manner. The beam is aimed at the most favorable spot for a calculated point of collision with the attacking missile—that is, the intersection point of the respective trajectories. The intercepting rocket is thus provided with a rearwardly directed receiver that operates in the corresponding wavelength range, the signals from this receiver are evaluated with an on board steering computer (not shown) for aiming at the point of collision with the attacking missile. In this system, the intercepting rocket simply follows the beam to the desired point of collision.

The optical jamming system can be designed so that the laser 5, aiming optics 4, and tracker 6 form a laser Doppler radar, which measures the speed of the attacking missile and feeds it as a result to the combat success sensor 8. (Alternatively, the same elements may form a laser rangefinder whose measurement signals are likewise fed to the combat success sensor 8.) The combat success sensor then compares the values of the radial speed and range of the missile (which are continuously measured during optical jamming) as well as the direction toward the missile. From this information it derives the anticipated trajectory of the missile and compares it with the trajectory determined at the beginning of optical jamming. If these two trajectories differ from one another sufficiently that a hit will not occur, the operation is rated as a combat success. Thereafter, any additional attacking missiles can be combated.

In another embodiment, the proposed device for missile self-defense also has a launcher 16 for optical decoys. In that case, the system control computer, depending on the trajectory of the attacking missile as determined by the missile proximity sensor, tracker, and combat success sensor, determines whether the use of optical jamming system, decoys, or intercepting rockets or a combination thereof should be used and activated. (Optical decoys are used if the incoming missile is detected at a very short range, for example, less than 500 meters, or if there are more than two incoming missiles at the same time.) In this case and in general a sensor that is sensitive in the UV wavelength range may be used as the missile proximity sensor. This type of sensor detects the incoming enemy missile from the UV emissions of its exhaust.

The intercepting rocket 11 that operates with semi-active steering methods 9 can be equipped, for example, with a simple homing head mounted symmetrically with respect to its axis. The head consists of a plurality of detector elements and a receiving lens with an interference filter connected ahead of it and tuned to the laser wavelength. The laser light back scattered from the attacking missile is readily imaged, defocussed, on the detector elements, whereupon the detector electronics analyze the received intensities. From this information it derives the incoming direction of the reflected laser light and feeds it to the steering computer. This semi-active steering method for the intercepting rockets can operate, for example, by the so-called "dog curve method" without an inertial system, or by the so-called "proportional navigation method" with an inertial system aboard the intercepting rocket.

Figure 2:
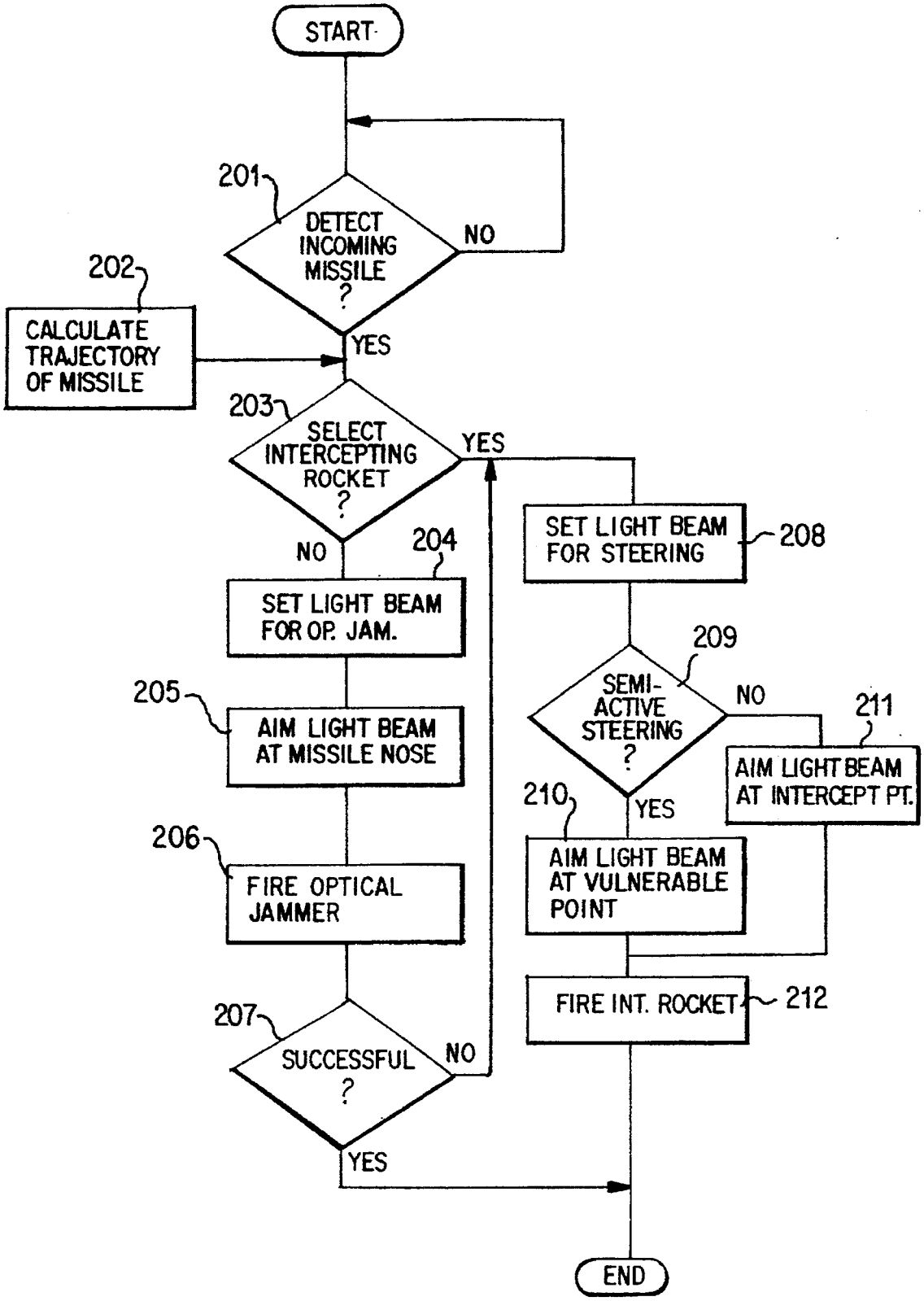
FIG. 2 is a block diagram which shows the process steps performed by the missile defense system according to the invention.

FIG. 2 is a flow diagram which illustrates the operation of a missile defense system according to the invention. Upon detection of an incoming missile in step 201, a calculation is made of its trajectory in step 202. Thereafter, a determination is made in step 203 whether to use an intercepting rocket, based on the considerations described previously. If an intercepting rocket is selected, in step 208, the light beam is set for steering (as oppose to jamming), and a determination is made in step 209 as to which type of steering (semi-active or beam rider) will be used. If semi-active steering is selected, in step 210 the light beam is aimed at the most vulnerable point of the missile, as described previously, and the rocket is fired in step 212. If the beam rider method is selected, the light beam is aimed at the calculated intercept point in step 211, and the rocket is fired.

If the use of an intercepting rocket is not selected in step 203, then the light beam is set for optical jamming in step 204, and is aimed at the nose of the incoming missile (step 205). Thereafter, the optical jammer is fired in step 206 and a determination is made in step 207 whether the jamming was successful. If so, the process is ended. If not, however, processing proceeds to step 208, and an intercepting rocket is deployed in the manner described previously.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A missile defense system comprising:

a control computer;

a proximity sensor for detecting the presence of an incoming missile;

an intercepting rocket system which can be guided by a semi-active steering method or by a beam rider steering method; and an optical jamming device which includes a light source, aiming optics and an aiming control system for controlling said aiming optics to direct a light beam from said light source in a direction determined by the control computer as a function of at least a trajectory of said incoming missile;

wherein said control computer comprises i) first means for selecting either optical jamming or an intercepting rocket to combat said incoming missile;

ii) second means, operative if an intercepting rocket is selected, for selecting a semi-active steering method or a beam rider steering method for guiding said intercepting rocket;

iii) third means responsive to selection by said first and second means for modulating a light beam from said light source to set parameters which are suitable for optical jamming or for a selected steering method;

iv) fourth means for calculating a trajectory of said incoming missile and a collision point of said incoming missile and an intercepting rocket; and v) fifth means for selecting a direction of said light beam toward a nose of said incoming missile if optical jamming has been selected, to a point of maximum vulnerability of said missile if semi-active steering of an intercepting rocket is selected, or to said collision point if beam rider steering has been selected.

2. Missile defense system according to claim 1 which is carried aboard an aircraft, wherein said control computer calculates the direction of the light beam as a function of a trajectory of said incoming missile and a flight path of said aircraft.

3. Missile defense system according to claim 1 wherein said intercepting rocket has a homing head which, in the semi-active steering method, is aimed before the intercepting rocket is fired at the missile, and firing takes place only after the homing head has detected light reflected from the missile.

4. Missile defense system according to claim 1 wherein the light beam comprises wavelengths within at least one wavelength range that is suitable for optical homing heads.

5. Missile defense system according to claim 1 wherein the light source comprises at least one laser.

6. Missile defense system according to claim 1 wherein the optical jamming and steering system further comprises a tracker which measures and analyzes light reflected from the missile and feeds it to the control computer, which controls the aiming optics to hold the light beam on a selected point on the missile.

7. Missile defense system according to claim 6 further comprises a combat success sensor associated with said control computer, said combat success sensor, including means for analyzing signals from the proximity sensor, the tracker, and inertial sensors of an aircraft, and for determining during optical jamming of the incoming missile whether the trajectory of the incoming missile has been sufficiently diverted due to jamming by the light beam, wherein in the absence of combat success, the control computer switches from optical jamming of the incoming missile to using intercepting rockets.

8. Missile defense system according to claim 7 wherein the light source comprises a laser formed by diode-pumped solid state lasers with an optical-parametric oscillator connected downstream, said laser emitting a laser beam with at least one wavelength in the ranges 0.7–1.2 μm, 2–3 μm, and 3–5 μm; and upon switching to intercepting rockets the laser is modified so that either the laser light generated by the solid-state laser or the laser light generated directly by the laser diodes is emitted.

9. Missile defense system according to claim 8 wherein the laser, aiming optics, and tracker of the optical jamming and steering system simultaneously or alternately form a laser-Doppler radar that measures the speed of the missile; and signals from the Doppler radar are fed to the combat success sensor.

10. Missile defense system according to claim 8 wherein the laser, aiming optics, and tracker of the optical jamming and steering system simultaneously form a laser rangefinder that measures the range of the missile; and signals from the laser rangefinder are fed to the combat success sensor.

11. Missile defense system according to claim 10 further comprising a launcher for optical decoys, wherein the control computer, after measuring the trajectory of the incoming missiles as determined by the proximity sensor, tracker and combat success sensor, selects use of an optical jamming system, decoys and intercepting rockets.

12. Missile defense system according to claim 11 wherein the missile proximity sensor is sensitive in the UV wavelength range.

13. Method of defending against an incoming missile comprising the steps of:

first, providing a missile diverting or destroying system comprising a proximity sensor for detecting the presence of an incoming missile, an intercepting rocket system which can be guided by a semi-active steering method or a beam rider steering method, and an optical jamming and steering system which includes a light source, aiming optics and an aiming control system for controlling said aiming optics to direct a light beam from said light source in a direction determined as a function of at least a trajectory of said incoming missile;

second, detecting an incoming missile by means of said proximity sensor;

third, calculating a trajectory of said incoming missile and a collision point of said incoming missile and an intercepting rocket;

fourth, selecting either optical jamming or an intercepting rocket to combat said incoming missile;

fifth, if an intercepting rocket is selected, further selecting a semi-active steering method or a beam rider steering method for guiding said intercepting rocket;

sixth, based on selections in said fourth and fifth steps, modulating a light beam from said light source to set parameters suitable for optical jamming or for a selected steering method;

seventh, selecting a direction of said light beam toward a nose of said incoming missile if optical jamming has been selected, to a point of maximum vulnerability of said missile if semi-active steering of an intercepting rocket is selected, or to said collision point if beam rider steering has been selected;

eighth, aiming said light beam in the selected direction; and ninth, if an intercepting rocket is selected, firing said intercepting rocket.

* * * * *